US010895061B2

(12) United States Patent
Rivard et al.

(10) Patent No.: US 10,895,061 B2
(45) Date of Patent: Jan. 19, 2021

(54) MOTORIZED VEHICLE FOR RECYCLING AGGREGATES AND MOTORIZED UNIT FOR MAKING TRENCHES INCLUDING SUCH A MOTORIZED VEHICLE

(71) Applicant: GROUPE MARAIS, Durtal (FR)

(72) Inventors: Daniel Rivard, Paris (FR); Philippe Dhervilly, Cresserons (FR)

( * ) Notice: Subject to any disclaimer, the term of this patent is extended or adjusted under 35 U.S.C. 154(b) by 7 days.

(21) Appl. No.: 16/476,832

(22) PCT Filed: Jan. 11, 2018

(86) PCT No.: PCT/FR2018/050066

§ 371 (c)(1),
(2) Date: Jul. 9, 2019

(87) PCT Pub. No.: WO2018/130788

PCT Pub. Date: Jul. 19, 2018

(65) Prior Publication Data

US 2019/0376258 A1 Dec. 12, 2019

(30) Foreign Application Priority Data

Jan. 12, 2017 (FR) ..... 17 50258

(51) Int. Cl.
*E02F 5/12* (2006.01)
*E01C 23/06* (2006.01)
(Continued)

(52) U.S. Cl.
CPC ..... *E02F 5/12* (2013.01); *E01C 23/065* (2013.01); *E02F 7/02* (2013.01); *E02F 7/06* (2013.01); *E02F 5/08* (2013.01); *E02F 5/10* (2013.01)

(58) Field of Classification Search
CPC .. E01C 23/065; E02F 5/08; E02F 5/10; E02F 5/12; E02F 7/02; E02F 7/06
(Continued)

(56) References Cited

U.S. PATENT DOCUMENTS 4,913,586 A 4/1990 Gabbita
4,946,307 A * 8/1990 Jakob ..... E01C 23/065 404/90

(Continued)

FOREIGN PATENT DOCUMENTS

FR 2749866 A1 12/1997
FR 2822862 A1 10/2002
JP 2000-345578 A 12/2010

OTHER PUBLICATIONS

International Search Report dated Apr. 5, 2018, issued in corresponding International Application No. PCT/FR2018/050066, filed Jan. 11, 2018, 2 pages.

(Continued)

*Primary Examiner* — Raymond W Addie
(74) *Attorney, Agent, or Firm* — Christensen O'Connor Johnson Kindness PLLC

(57) ABSTRACT

A motorized vehicle for recycling aggregates includes a chassis and an engine unit, and, mounted on the chassis, a device for collecting aggregates, a crushing chamber supplied with aggregates by the device for collecting aggregates, by mechanical collection or by suction, and configured to crush the aggregates and to supply crushed aggregates to an outlet, a mixing device connected to the crushing chamber to receive at least one portion of the crushed aggregates available at the outlet of the crushing chamber and configured to mix these received crushed aggregates with at least one binder so as to produce a mortar, and a distribution channel configured to distribute the produced mortar at the outlet of the mixing device.

12 Claims, 5 Drawing Sheets

(51) Int. Cl.

| | |
|---|---|
| ***E02F 7/02*** | (2006.01) |
| ***E02F 7/06*** | (2006.01) |
| *E02F 5/08* | (2006.01) |
| *E02F 5/10* | (2006.01) |

(58) Field of Classification Search
USPC ..... 404/90–93, 101
See application file for complete search history.

(56) References Cited

U.S. PATENT DOCUMENTS

| | | | | |
|---|---|---|---|---|
| 5,342,124 | A * | 8/1994 | Swisher, Jr. ..... | B01F 7/00158 366/173.2 |
| 10,407,849 | B1 * | 9/2019 | Matthews ..... | E01C 19/1077 |
| 2002/0139014 | A1 | 10/2002 | Rivard | |
| 2018/0297788 | A1 * | 10/2018 | Grathwol ..... | E01C 23/065 |
| 2019/0153681 | A1 * | 5/2019 | Christian ..... | E01C 11/005 |
| 2019/0292734 | A1 * | 9/2019 | Christian ..... | E01C 23/065 |
| 2019/0292735 | A1 * | 9/2019 | Coe ..... | E01C 23/14 |

OTHER PUBLICATIONS

Written Opinion of the International Searching Authority dated Apr. 5, 2018, issued in corresponding International Application No. PCT/FR2018/050066, filed Jan. 11, 2018, 6 pages.

Preliminary International Report on Patentability dated Jul. 16, 2019, issued in corresponding International Application No. PCT/FR2018/050066, filed Jan. 11, 2018, 1 page.

* cited by examiner

MOTORIZED VEHICLE FOR RECYCLING AGGREGATES AND MOTORIZED UNIT FOR MAKING TRENCHES INCLUDING SUCH A MOTORIZED VEHICLE

The present invention relates to a motorised vehicle for recycling aggregates, as well as a motorised unit for making trenches in the ground, which comprises such a motorised vehicle for recycling aggregates.

The motorised unit for making trenches in the ground, has the function of making trenches for placing extended objects such as, for example, optical and/or electrical cables, pipelines and/or hoses, etc.

Generally, making such a trench in the ground, which can be the pavement or roadside of a road or similar, is carried out by a digging device with a cutting wheel supported by a specific motorised vehicle. To reduce the duration of works due to the inconvenience caused by this, another vehicle is often used to suction and recover the aggregates produced during the digging of the trench at the outlet of the tunnel face of the cutting wheel.

By patent FR-2 822 862, a vehicle is known which simultaneously ensures the two functions of digging the trench and suctioning (and collecting) the aggregates, which makes it possible, under working conditions, to considerably reduce the inconvenience caused during the execution of works on the road network and to also decrease the logistics incurred and, therefore, the implementation costs.

However, for such a site making trenches or for any other site for which aggregates are generated, the question is still posed regarding the evacuation of aggregates from the site, then the processing, recycling or storage thereof.

These operations have significant costs (logistics and labour).

The present invention aims to overcome these disadvantages. It relates to a motorised vehicle for recycling aggregates, comprising a chassis and a motorised unit.

To this end, according to the invention, said motorised vehicle comprises, mounted on the chassis:

- a device for collecting aggregates;
- a crushing chamber supplied with aggregates by said device for collecting aggregates, and configured to crush the aggregates and to supply crushed aggregates to an outlet;
- a mixing device connected to the crushing chamber to receive at least one portion of the crushed aggregates available at the outlet of the crushing chamber and configured to mix these crushed aggregates received with at least one binder to produce a mortar; and
- a distribution channel configured to distribute the produced mortar at the outlet of the mixing device.

Thus, the motorised vehicle according to the invention makes it possible to both:

- collect on a site, for example, on a trench digging site, the produced aggregates; and
- transform them into mortar, which is used directly on the site, for example to close a trench formed beforehand in the case of a trench digging site, after the placing in the dug trench, extended objects such as cables, for example.

The present invention therefore makes it possible for an effective recycling, directly on the site, of all the produced aggregates, and this using one single and same motorised vehicle, which makes it possible, on the one hand, to avoid the usual costs for evacuating aggregates and, on the other hand, to have mortar (self-compacting, fluid, homogenous and stable) ready to use on the site.

In a preferred embodiment, the motorised vehicle comprises a screen arranged between the crushing chamber and the mixing device.

Advantageously, the motorised vehicle is configured to separate the aggregates available at the outlet of the crushing chamber according to a predetermined size, the aggregates of which the size is less than or equal to said predetermined size being transmitted to the mixing device and the aggregates of which the size is greater than said predetermined size being sent back into the crushing chamber.

Furthermore, preferably, said crushing chamber and said screen each have, a working direction between the respective inlet thereof and outlet thereof, which is transversal with respect to a longitudinal direction of the chassis of the vehicle, and said vehicle comprises transfer channels, on the one hand, between the crushing chamber and the screen, and on the other hand, between the screen and the mixing device, these transfer channels each having a distribution direction which is substantially parallel to said longitudinal direction, which makes it possible to highly reduce the volume of the processing chain mounted on the chassis and thus, in particular, provide a shorter chassis.

In a first embodiment, the device for collecting aggregates comprises a suction device, while in a second embodiment, said device for collecting aggregates comprises a conveyor or another mechanical loading means.

Furthermore, advantageously:

- the crushing chamber is configured to function in depression;

and/or

- the motorised vehicle comprises a weighing unit to weigh the crushed aggregates entering into the mixing device.

The present invention also relates to a motorised unit for making trenches.

According to the invention, this motorised unit comprises:

- a system for making trenches in the ground, comprising at least one trench digging device. Preferably, the system for making trenches also comprises a system for suctioning and collecting produced aggregates during the digging of a trench, this trench making system thus preferably corresponding to the device described in patent FR-2 822 862; and
- a motorised vehicle for recycling aggregates such as described above, which is configured to use at least one portion (and preferably the main portion) of the produced aggregates during the digging of the trench by said trench making system and, preferably, to close at least one portion of the trench using the mortar produced and supplied at the outlet of the mixing device.

In a first embodiment, the trench making system comprises an autonomous auxiliary engine unit, and it is connected to said motorised vehicle for recycling aggregates, at least for collecting aggregates. Advantageously, the motorised unit comprises a means for subjugating the forward speed of the two system: of the trench making system and the motorised vehicle for recycling aggregates.

Furthermore, in a second embodiment, the trench making system is mounted on the chassis of the motorised vehicle for recycling aggregates. In this second embodiment, all the means (systems, devices, etc.) for making trenches and recycling aggregates, is mounted on one single and same motorised vehicle.

Moreover:

- in a first embodiment, the device for collecting aggregates (from the motorised vehicle) forms part of a system for suctioning and collecting (from the trench making system); and in a second embodiment, said device for collecting aggregates (from the motorised vehicle) comprises a mechanical loading means.

The invention will be best understood, and other aims, details, features and advantages of it will appear more clearly during the following detailed explanatory description, embodiments of the invention given as purely illustrative and non-limiting examples, in reference to the appended schematic drawings. In these drawings.

Figure 1:
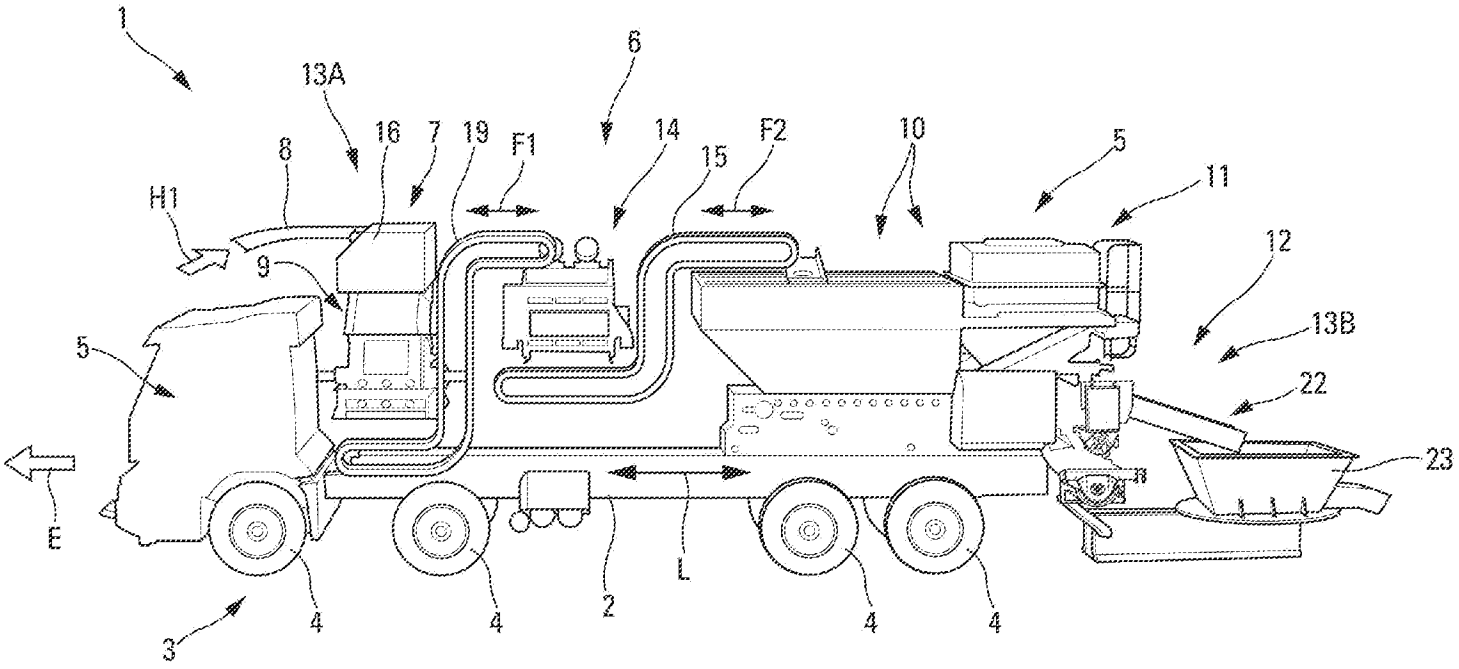
FIG. 1 is a slightly perspective, side view of a specific embodiment of a motorised vehicle for recycling aggregates according to the invention.
Figure 2:
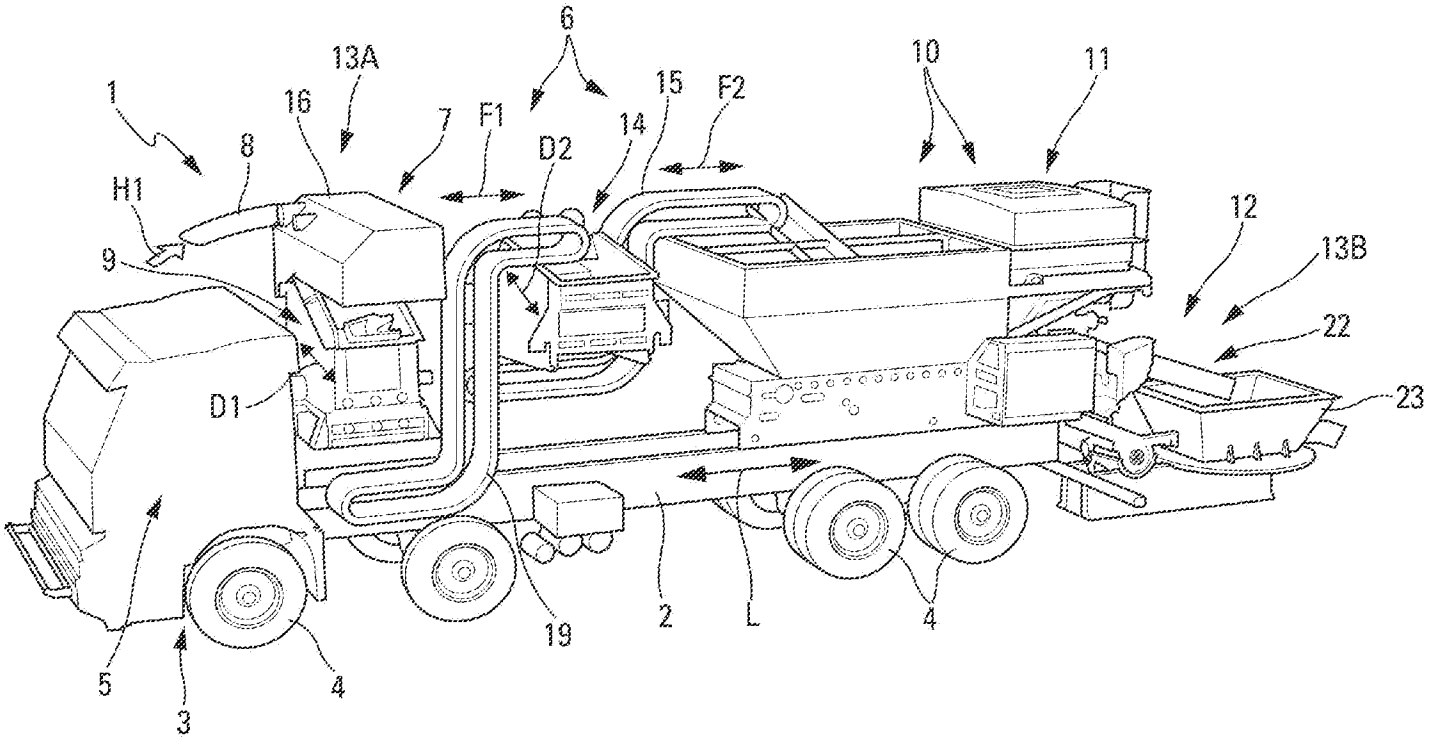
FIG. 2 is a perspective view of the motorised vehicle shown in FIG. 1.

According to the invention, the motorised vehicle 1 represented in FIGS. 1 and 2 is a mobile vehicle for recycling aggregates. This motorised vehicle 1 comprises a chassis 2 of longitudinal axis L and an engine unit 3 associated with four axles provided with wheels 4 to generate the movement of the motorised vehicle 1 on the ground, in the direction illustrated by an arrow E in FIG. 1. In FIGS. 1 and 2, the driver's cabin 5 is represented very schematically.

According to the invention, said motorised vehicle 1 comprises a processing chain 6 which is mounted on the chassis 2. This processing chain 6 comprises, mounted on the chassis 2 from the front 13A to the rear 13B of the chassis 2:

- a collection device 7 configured to bring the aggregates into the processing chain 6. In FIGS. 1 and 2, a portion of a pipe (or hose) 8 of the collection device 7 has been represented, through which the aggregates are recovered, which are generally available at the level of the ground, in front of or to the side of the motorised vehicle 1. In a preferred application, described below, the aggregates are extracted from the pavement or roadside by a cutting wheel which, itself, is streamlined such that the aggregates are more easily collected and take a suction flow to a crushing chamber 9;
- the crushing chamber 9 supplied with aggregates by said collection device 7, and configured to crush the aggregates received and to supply crushed aggregates to an outlet;
- a mixing device 10 connected in the manner specified below to the crushing chamber 9 so as to receive at least one portion of the crushed (calibrated) aggregates available at the outlet of the crushing chamber 9. This mixing device 10 is configured to mix the crushed aggregates received, with at least one binder (or cement) and water available in tanks localised by an arrow 11, in order to produce a mortar; and
- a distribution channel 12 configured to distribute (i.e. to supply) the produced mortar at the outlet of the mixing device 10, to the rear 13B of the motorised vehicle 1.

Thus, the motorised vehicle 1 makes it possible to both:

- collect on a site, the aggregates which are produced or available on this site; and
- transform them into mortar, which is used directly on said site.

The present invention therefore makes it possible for an effective recycling directly on the site of all of the produced aggregates, and this using one single and same motorised vehicle 1.

In a preferred embodiment, represented in FIGS. 1 and 2, the motorised vehicle 1 also comprises a screen 14. This screen 14 is arranged between the crushing chamber 9 and the mixing device 10.

Figure 3:
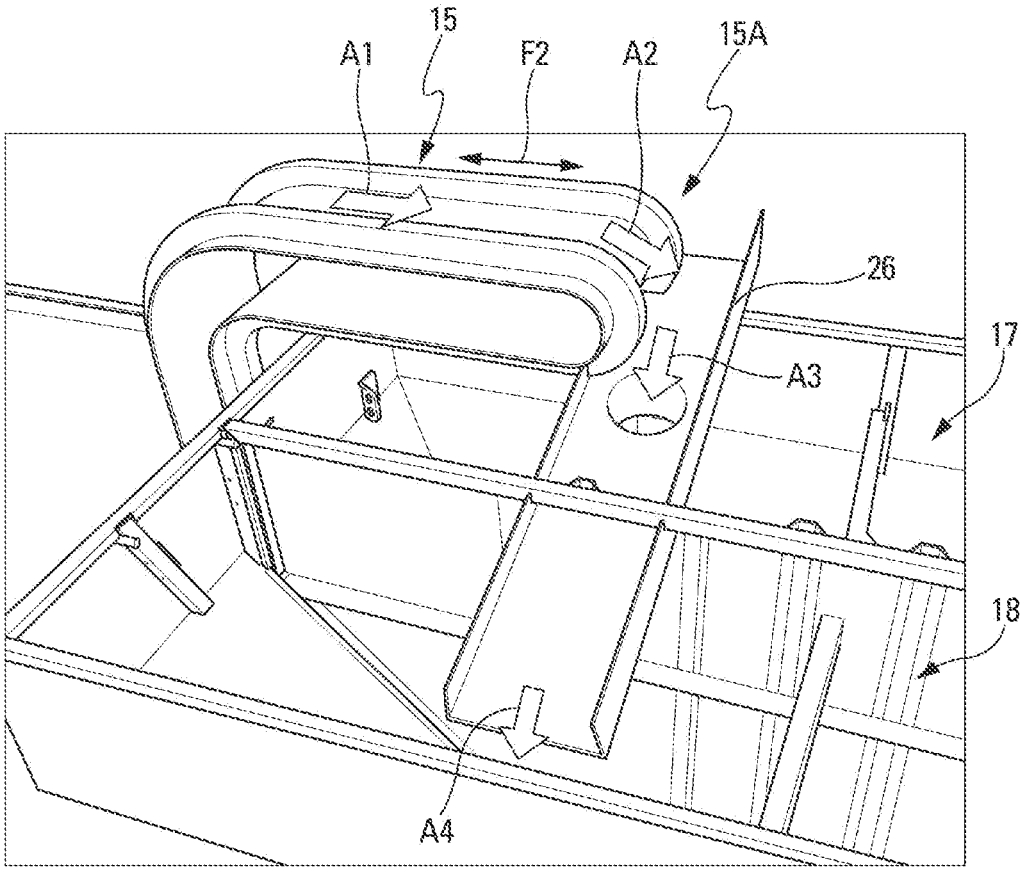
FIG. 3 is a partial, perspective view, at an enlarged scale, of a portion of a crushed aggregate transfer channel.

The screen 14 is configured to separate the aggregates available at the outlet of the crushing chamber 9 according to a predetermined size. The aggregates of which the size is less than or equal to said predetermined size, are transmitted to the mixing device 10 via a transfer channel 15 of which an end 15A opens, for example, above a ramp 26 making it possible for the crushed aggregates to access into the tanks 17 and 18 of the mixing device 10, as illustrated schematically by the arrows A1 to A4 in FIG. 3. The aggregates of which the size is greater than said predetermined size are, themselves, sent back into the crushing chamber 9.

To transfer aggregates from one unit to another inside the processing chain 6, the motorised vehicle 1 comprises transfer channels 15 and 19 which can be carried out in different usual manners. They can include, for example, a conveyor.

In a preferred embodiment, the crushing chamber 9 has a working direction D1 between the inlet thereof and the outlet thereof, and the screen 14 has a working direction D2 between the inlet thereof and the outlet thereof, as represented in FIG. 2. By working direction of any unit, this means the direction according to which the products move, in particular the aggregates, inside the unit considered during the processing thereof.

The working directions D1 and D2 are lateral, i.e. transversal to the longitudinal direction L of the chassis 2 of the vehicle 1. In other words, they are inclined with respect to this longitudinal direction L and therefore not parallel to the latter. Preferably, the working directions D1 and D2 are substantially orthogonal to the longitudinal direction L, as represented in FIG. 2.

In addition, the motorised vehicle 1 comprises a transfer channel 19 between the crushing chamber 9 and the screen 14, and the transfer channel 15 between the screen 14 and the mixing device 10. The transfer channels 19 and 15 each have a transfer direction F1 and F2 which is substantially parallel to said longitudinal direction L.

This preferred embodiment with a crushing chamber 9 and a screen 14 working laterally (directions D1 and D2), associated with longitudinal transfers of aggregates (directions F1 and F2), makes it possible to highly reduce the volume of the processing chain 6 mounted on the chassis 2 and thus to provide a shorter chassis 2. This preferred embodiment has numerous advantages. It thus makes it possible, in particular, to reduce the possible inconvenience caused during the execution of works on the road network.

The collection device 7 intended to collect the aggregates to be processed and bring them to the crushing chamber 9 can be carried out in different manners.

In a first preferred embodiment, the device for collecting aggregates 7 comprises a suction device 16, as represented in FIGS. 1 and 2. In this embodiment, the suction device 7 comprises, a device such as a turbine to generate a depression in the pipe 8 (or hose) of which the free end accesses to aggregates to be recovered to suction them. In the application described below, the suction device 7 can be supplied in a suction flow by a turbine located on a trenching system placed in front of the motorised vehicle 1.

Preferably, the suction device 16 is positioned above the crushing chamber 9 such that the aggregates which are suctioned by the flow of the suction device can descend directly by gravity into the crushing chamber 9.

Furthermore, in a second embodiment (not represented), said collection device 7 comprises a conveyor, in a mechanical loading embodiment.

Moreover, in a preferred embodiment, the crushing chamber 9 is configured to function in depression. The crushing chamber 9 aims to give the aggregates the grain size fraction sought to produce the mortar.

The motorised vehicle 1 also comprises a weighing unit (not represented) to weigh the crushed aggregates entering into the mixing device 10, in order to know the weight thereof and to be able to add suitable weights of binder (or cement) and water (available in the tanks shown by the arrow 11) to produce, by a usual blending, a mortar having the sought properties.

Figure 4:
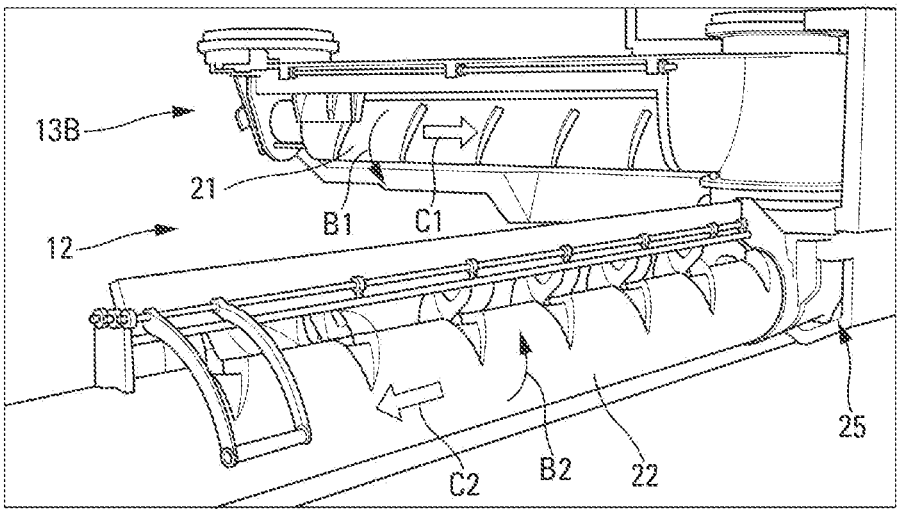
FIG. 4 is a partial, perspective view, at an enlarged scale, of a mortar distribution channel.
Figure 5:
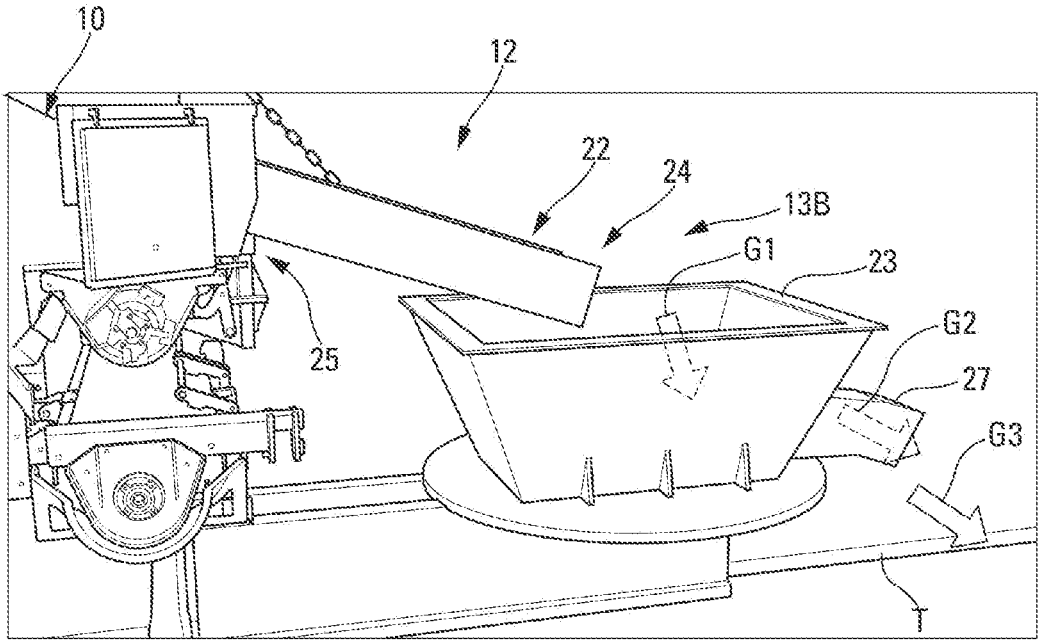
FIG. 5 is a partial, perspective view, of the rear of the motorised vehicle comprising the mortar distribution channel.

This mortar is distributed to the rear 13B of the motorised vehicle 1 using the distribution channel 12 shown in FIGS. 4 and 5.

The distribution channel 12 comprises two worm screws 21 and 22 connected to one another. The first screw 21 is arranged transversally to the longitudinal axis to the rear 13B of the motorised vehicle 1 as represented in FIG. 4, and it is supplied by the mortar produced by the mixing device 10. During the rotation of the worm screw 21, illustrated by an arrow B1, the produced mortar is moved in the direction illustrated by an arrow C1 to result in the second screw 22. The latter, by the rotation thereof illustrated by an arrow B2, moves the mortar in the direction illustrated by an arrow C2. At the outlet of the screw 22, at the rear end 24 thereof, the mortar can be recovered in a collecting tray 23, as illustrated by an arrow G1 in FIG. 5.

To make it possible to adapt the outlet position, namely the rear free end 24 of the screw 22 according, in particular, to the positioning of the collecting tray 23, the screw 22 is articulated, via a usual articulation 25, to the screw 21. It can be moved angularly and adopt a position which is either directed along the longitudinal axis, or inclined laterally with respect to this longitudinal axis.

The collecting tray 23 is guided by two guides in the trench and supported to the right and left of it on two support plates. It is supplied with mortar through the top and supplies the trench T by gravity, as illustrated by the arrows G1, G2 and G3 in FIG. 5. The collecting tray 23 is provided in the low rear part thereof of an evacuation conduit 27. Preferably, the mixing device 10 (or mortar or concrete station) is configured to produce a self-compacting mortar (or concrete), which facilitates the implementation thereof in the trench T.

In the scope of the present invention, the motorised vehicle 1 can be mounted on a trailer or an 8×4 lorry or on any other site vehicle or motorised means, to transport the processing unit 6.

The motorised vehicle 1 has, furthermore, a hydrostatic or electrical drive, capable of being adjusted, preferably, in a range of 0 to 1 km/h.

The motorised vehicle 1 can include an electrical supply by continuous magnet generator.

The functioning of the mobile motorised vehicle 1, such as described above and represented, in particular in FIGS. 1 and 2, is as follows.

Aggregates located at the level of the ground, either to the front of the motorised vehicle 1, or laterally to the motorised vehicle 1, are recovered, preferably suctioned, by the collection device 7 as illustrated by an arrow H1 in FIGS. 1 and 2. The collection device 7 brings these aggregates into the processing chain 6 and more specifically, into the crushing chamber 9. After crushing, the aggregates are transferred to the screen 14 via the transfer channel 19. The screen 14 implements a separation of aggregates such that the sufficiently crushed aggregates are transmitted to the mixing device 10 via the transfer channel 15 as illustrated by the arrows A1 to A4 in FIG. 3, while the insufficiently crushed aggregates are sent back into the crushing chamber 9 via a transfer channel, not represented. The mixing device 10 mixes the aggregates received with suitable quantities of water and binder to form a mortar. This mortar is then distributed to the rear of the motorised vehicle 1, by way of the distribution channel 12, via the collecting tray 23, as shown in FIG. 5, in particular.

The motorised vehicle 1, such as described above, comprising a processing chain 6 which continuously produces mortar ready to use, has numerous advantages. In particular, it carries out an effective recycling, directly on the site, of all of the produced aggregates, and this using one single and same motorised vehicle, which makes it possible, on the one hand, to avoid the usual costs of evacuating aggregates, and on the other hand, to have mortar on the site.

The motorised vehicle 1, such as described above, can be used as an autonomous system. In this case, the collection device 7, preferably a suction device, collects aggregates arranged in particular on the ground, from the front or the side of the motorised vehicle 1, and brings them to the processing chain 6, and the processing chain 6 transforms them into mortar, which is available to the rear 13B of the motorised vehicle 1. As an illustration, the aggregates can be aggregates generated by a digging, for example, a trench, or rubble generated by the demolition of work.

Figure 6:
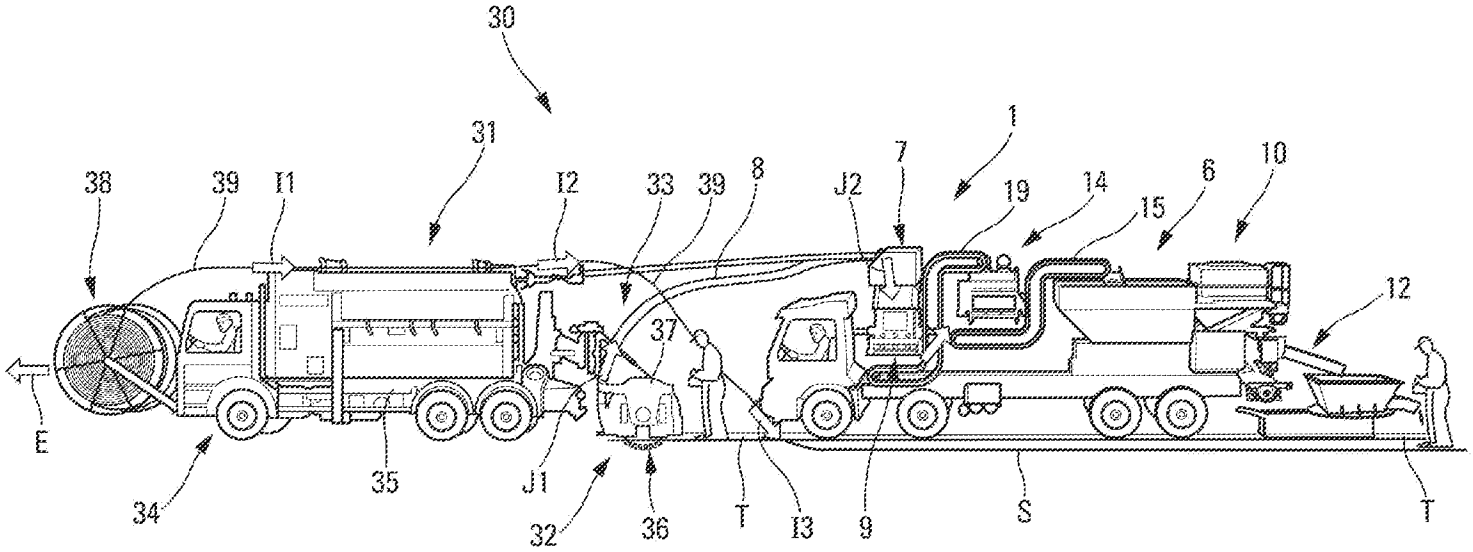
FIG. 6 is a side view of a specific embodiment of a motorised unit for making a trench and recycling aggregates, represented during the execution of a trench.

In a preferred application, the motorised vehicle 1 for recycling aggregates, such as described above, forms part of a motorised unit 30 for making trenches, as represented as an example in FIG. 6.

This motorised unit 30 comprises, in addition to the motorised vehicle 1, a system 31 for making trenches in the ground. This system 31 comprises, in particular, a trench digging device 32 and a system 33 for suctioning and collecting aggregates produced during the digging of a trench by the device 32. This trench making system 31 corresponds, preferably, to the device described in patent FR-2 822 862.

In the embodiment represented in FIG. 6, the trench making system 31 comprises an autonomous auxiliary engine unit 34, and it is connected to said motorised vehicle 1 for recycling aggregates, as specified below.

The system 31 represented in FIG. 6 comprises, on a chassis 35, the device for digging 32 by cutting wheel 36 to make a trench T in the ground S (a road, for example). The digging device 32 is located in the rear portion of the chassis 35. Usually, the cutting wheel 36 is provided at the periphery thereof with cutting members. In the example illustrated, the wheel is intended to make narrow and shallow trenches, in particular for the placing of cables (optical, electrical, telephone, etc.).

In the embodiment example represented, the suction and collection device 33 comprises, a device for generating a depression, such as a turbine, and a casing 37 partially surrounding the cutting wheel 36. In this embodiment example, the turbine is connected to the inner space between the casing 37 and the cutting wheel 36 by way of a hose 8. The latter is connected, on one side, to the suction socket arranged in the casing 37, and, on the other side, to the collection device 7 mounted on the motorised vehicle 1.

The motorised vehicle 1 uses aggregates produced during the digging of the trench by the system 31 and recovered via the device 7 for collecting aggregates, as illustrated by the arrows J1 and J2, to produce mortar. The mortar produced at the outlet of the mixing device 10, is preferably used, to close at least one portion of the trench T dug by said system 31.

In the embodiment, represented in FIG. 6, the device 7 for collecting aggregates forms part of said suction and collection device 33.

The motorised unit 30 thus makes it possible to use materials (rubble) excavated on site, for the immediate closing of the trench T by the produced mortar, which generates an optimisation of the logistics and product costs.

The system 31 also comprises a cable 39 coil 38 (optical fibre, etc.) or HDPE pipe, arranged at the front of the driver's cabin of said system 31.

The functioning of the motorised unit 30, such as described above, is as follows.

During the execution of the trench, the system 31 can be driven by a hydrostatic transmission also supplying the different servitudes (actuators, engines, etc.) and making it possible to easily adapt the advancement thereof in making the trench.

Preferably, the trench T is made with the cutting wheel 36 of the digging device 32 arranged in the median longitudinal axis of the system 31, orthogonally to the plane of the chassis 35. During the advancement of the system 31, via the rotation of the cutting wheel 36, the digging device 32 digs the trench T progressively. The aggregates produced by the excavation along the tunnel face are driven towards the inside of the casing 36, of which the inner space is in depression thanks to the functioning of the suction and collection device 7. The aggregates exiting the tunnel face are thus suctioned in the direction of the processing chain 6 of the motorised vehicle 1.

At the same time as digging the trench T, the cable or pipe 39, in particular a bundle of optical fibres, is unwound (as illustrated by the arrows I1, I2 and I3) from a coil 38 arranged at the front of the system 31, using usual means. This cable or pipe 39 passes above the system 31 and is placed downstream of the cutting wheel 36, between the latter and the motorised vehicle 1, in the trench T.

Regarding the aggregates recovered in the processing chain 6, as illustrated by the arrows J1 and J2, they are processed as specified below in reference to FIGS. 1 and 2, to produce mortar. This mortar is finally used at the rear of the motorised vehicle 1 to fill the trench T.

In this embodiment, the system 31 and the motorised vehicle 1 is moved at the same speed, one behind the other, in the direction indicated by the arrow E in FIG. 6.

Preferably, the motorised unit 1 comprises a means (for example, a radar or any other possible means) for subjugating the forward speed of the two systems: of the system 31 and of the motorised vehicle 1.

In an embodiment variant (not represented), the motorised unit comprises, in addition to the motorised unit, a system for making trenches in the ground, but not a system for suctioning and collecting aggregates such as the abovementioned system 33. In this embodiment variant, the device 7 for collecting aggregates (from the motorised vehicle 1) is of the mechanical type, for example, an excavator or a telescopic vehicle or other, and it is configured to mechanically collect the aggregates generated by the trench making system.

Moreover, in another embodiment variant (not represented), the trench making system 31 can be mounted on the chassis 2 of the motorised vehicle 1 for recycling aggregates. In this embodiment variant, all of the means (systems, devices, etc.) for making trenches and recycling aggregates, is mounted on one single and same motorised vehicle.

The motorised unit 30, such as described above, has numerous advantages, and in particular:

- a saving of natural granulates, to produce mortar;
- a significant reduction of logistics costs (the evacuation of aggregates and providing mortar being removed); and
- a reduction of labour costs.

The motorised unit 30 thus generates an optimisation of costs for constructing networks, while improving the environment impact.

The invention claimed is:

1. A motorized vehicle for recycling aggregates, comprising a chassis and an engine unit, said vehicle comprising, mounted on the chassis:

- a device for collecting aggregates;
- a crushing chamber supplied with aggregates by said device for collecting aggregates, and configured to crush the aggregates and to supply crushed aggregates to an outlet;
- a mixing device connected to the crushing chamber to receive at least one portion of the crushed aggregates available at the outlet of the crushing chamber and configured to mix these crushed aggregates received with at least one binder to produce a mortar;
- a screen arranged between the crushing chamber and the mixing device; and
- a distribution channel configured to distribute the produced mortar at the outlet of the mixing device,
- said crushing chamber and said screen each having a working direction between the respective inlet thereof and outlet thereof, which is transversal with respect to a longitudinal direction of the chassis of the motorized vehicle, and said motorized vehicle comprising transfer channels, on the one hand, between the crushing chamber and the screen, and on the other hand, between the screen and the mixing device, the transfer channels each having a distribution direction which is substantially parallel to said longitudinal direction.

2. The vehicle according to claim 1, wherein the screen is configured to separate the aggregates available at the outlet of the crushing chamber according to a predetermined size, the aggregates of which the size is less than or equal to said predetermined size being transmitted to the mixing device and the aggregates of which the size is greater than said predetermined size being sent back into the crushing chamber.

3. The vehicle according to claim 1, wherein said device for collecting aggregates comprises a suction device.

4. The vehicle according to claim 1, wherein said device for collecting aggregates comprises a conveyor.

5. The vehicle according to claim 1, wherein the crushing chamber is configured to function in depression.

6. The vehicle according to claim 1, wherein the vehicle comprises a weighing unit to weigh the crushed aggregates entering into the mixing device.

7. A motorized unit for making trenches, wherein the unit comprises:

- a system for making trenches in the ground, comprising at least one trench digging device; and
- a motorized vehicle for recycling aggregates according to claim 1, configured to use at least one portion of the aggregates produced during the digging of the trench by said trench making system.

8. The unit according to claim 7, wherein the trench making system comprises a suction and collection system and wherein said device for collecting aggregates forms part of said suction and collection system of the trench making system.

9. The unit according to claim 7, wherein said device for collecting aggregates comprises a mechanical loading means.

10. The unit according to claim 7, wherein said trench making system comprises an autonomous auxiliary engine unit, and it is connected to said motorized vehicle for recycling aggregates.

11. The unit according to claim 10, wherein the unit comprises a means for subjugating the forward speed of the trench making system and the motorized vehicle for recycling aggregates.

12. The unit according to claim 11, wherein said trench making system is mounted on the chassis of the motorized vehicle for recycling aggregates.

* * * * *